US007195240B2

(12) United States Patent
Moteki

(10) Patent No.: US 7,195,240 B2
(45) Date of Patent: Mar. 27, 2007

(54) SHEET PROCESSING APPARATUS AND IMAGE FORMING APPARATUS

(75) Inventor: Junichi Moteki, Chiba-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/452,205

(22) Filed: Jun. 14, 2006

(65) Prior Publication Data

US 2006/0231999 A1 Oct. 19, 2006

Related U.S. Application Data

(62) Division of application No. 10/790,832, filed on Mar. 3, 2004, now Pat. No. 7,108,256.

(30) Foreign Application Priority Data

Mar. 4, 2003 (JP) ..... 2003-056689

(51) Int. Cl.
*B65H 5/06* (2006.01)

(52) U.S. Cl. ..... 271/273; 271/264; 271/272; 271/274; 270/58.01; 270/58.07; 270/58.08; 270/58.09; 399/407; 399/408; 399/410

(58) Field of Classification Search ..... 270/58.01, 270/58.07, 58.08, 58.09; 271/264, 272, 273, 271/274; 399/407, 408, 410
See application file for complete search history.

(56) References Cited

U.S. PATENT DOCUMENTS 5,409,202 A * 4/1995 Naramore et al. ..... 270/58.12
5,938,192 A * 8/1999 Kosasa ..... 271/221
6,145,825 A * 11/2000 Kunihiro et al. ..... 270/58.09
6,209,864 B1 * 4/2001 Taniguchi et al. ..... 271/220
6,398,214 B1 6/2002 Moteki et al. ..... 271/220
2003/0049063 A1 3/2003 Suzuki et al. ..... 399/407

FOREIGN PATENT DOCUMENTS

JP 9-235041 9/1997

* cited by examiner

*Primary Examiner*—Gene O. Crawford
*Assistant Examiner*—Leslie A. Nicholson, III
(74) *Attorney, Agent, or Firm*—Fitzpatrick, Cella, Harper & Scinto

(57) ABSTRACT

A sheet processing apparatus comprising a stack means for stacking sheets to be fed; a feeding path comprising guide members for feeding the sheets to the stack means, disposed facing with each other; a discharging means for discharging the sheets to the stack means; and a sheet processing means capable of moving in the sheet width direction for processing the sheets stacked on the stack means at a predetermined position. One of the guide members disposed facing with each other is divided into a plurality of parts in the sheet width direction such that the feeding path can be selectively opened per each part in a space for moving the sheet processing means in a space where the sheet processing means moves.

9 Claims, 13 Drawing Sheets

SHEET PROCESSING APPARATUS AND IMAGE FORMING APPARATUS

This application is a divisional of U.S. patent application Ser. No. 10/790,832, filed Mar. 3, 2004 now U.S. Pat. No. 7,108,256.

BACKGROUND OF THE INVENTION

1. Field of the Invention

The present invention relates to a sheet stacking and aligning device for aligning and stacking sheets, a sheet processing apparatus comprising the sheet stacking and aligning device, and an image forming apparatus comprising the sheet processing apparatus.

2. Description of the Related Art

Conventionally, for reducing the occupied area at the time of installing an image forming apparatus and a sheet processing apparatus in the sheet processing apparatus connected with the image forming apparatus such as a printing apparatus, a copying machine, and a printer, there is an image forming apparatus system comprising a sheet processing apparatus 500 between an image forming apparatus main body 200 (printer part) and an original reading device 150 as shown in FIG. 13.

According to the image forming apparatus system, a sheet S with an image formed by the image forming apparatus main body 200 is stacked temporarily on a processing tray 540 in the sheet processing apparatus 500 so as to execute the sheet process such as the aligning and binding process for the sheets S, or the like thereat. Thereafter, they are discharged to a stack tray 581 having an inclined stacking surface as shown in FIG. 13 by a bundle discharging means 580. The discharged sheets S are moved on the inclined stacking surface of the stack tray by their self weight so as to have the sheet rear end aligned by the rear end aligning wall. The number of the stacked sheets depends on the width of the vertically movable stroke of the stack tray 581.

Moreover, according to another sheet processing apparatus 500 connected with the image forming apparatus, for changing the binding position in the binding process to be executed by the sheet processing apparatus according to the paper size of the sheet S discharged from the image forming apparatus, the image orientation, the mode set by the user, or the like, a stapler for executing the binding process can be moved.

In contrast, in the case the sheet is choked in the feeding path 510 of the sheet processing apparatus 500, a left door 210 of the image forming apparatus main body 200 is opened in the arrow X direction of FIG. 13 and the upper feeding guide 501 of the sheet processing apparatus 500 is opened in the arrow Y direction for eliminating the choked sheet.

However, in the case the sheet is choked in the feeding path 510 of the sheet processing apparatus 500, since the choked sheet is eliminated by opening the upper feeding guide 501 of the sheet processing apparatus 500 in the arrow B direction, a problem is involved in that an space for opening the upper feeding guide 501 is required in the upper part of the upper feeding guide 501.

Moreover, since the number of sheets to be stacked on the sheet processing apparatus 500 depends on the vertical movable stroke of the stack tray 581, for enlarging the number of sheets to be stacked, the sheet processing apparatus should be shifted upward for enlarging the vertical movable stroke of the stack tray 581.

Therefore, in order to provide the space for eliminating the sheets choked in the feeding path 510 and enlarging the number of sheets to be stacked on the stack tray 581, a problem is involved in that the entire apparatus becomes bulky and the cost is increased.

SUMMARY OF THE INVENTION

Accordingly, an object to the present invention is to provide a sheet processing apparatus capable of ensuring the space for eliminating choked sheets, and realizing the miniaturization of the apparatus while achieving a large amount of the sheets to be stacked.

In order to solve the above-mentioned problems, a representative configuration of the sheet processing apparatus according to the present invention comprises a stacking means for stacking sheets fed from an image forming apparatus main body, a feeding path comprising guide members for feeding the sheets to the stack means, disposed facing with each other, a discharging means for discharging the sheets to the stack means, and a sheet processing means for processing a sheet bundle stacked on the stack means at a predetermined position, wherein one of the guide members disposed facing with each other is divided in the sheet width direction so as to be selectively opened or closed in a space where the sheet processing means moves.

Since one of the guide members disposed facing with each other is divided so as to be opened, the eliminating processing space for eliminating a sheet choked in the feeding path of the sheet processing apparatus can be ensured so that the operability can be improved. Moreover, since one of the feeding rollers is supported by the divided guide member and the other feeding roller provided to the facing guide member is forced per the divided guide member, the feeding roller can be pressured evenly so that obliqueness of the sheet generated by the uneven feeding roller pressure can be prevented.

Moreover, since the guide member divided in the sheet width direction can be opened or closed in the space for moving the processing means, the miniaturization of the apparatus can be realized while achieving a large number of the sheets to be stacked without the need of additionally providing a rotating space for the divided guide members.

DESCRIPTION OF THE PREFERRED EMBODIMENT

Figure 1:
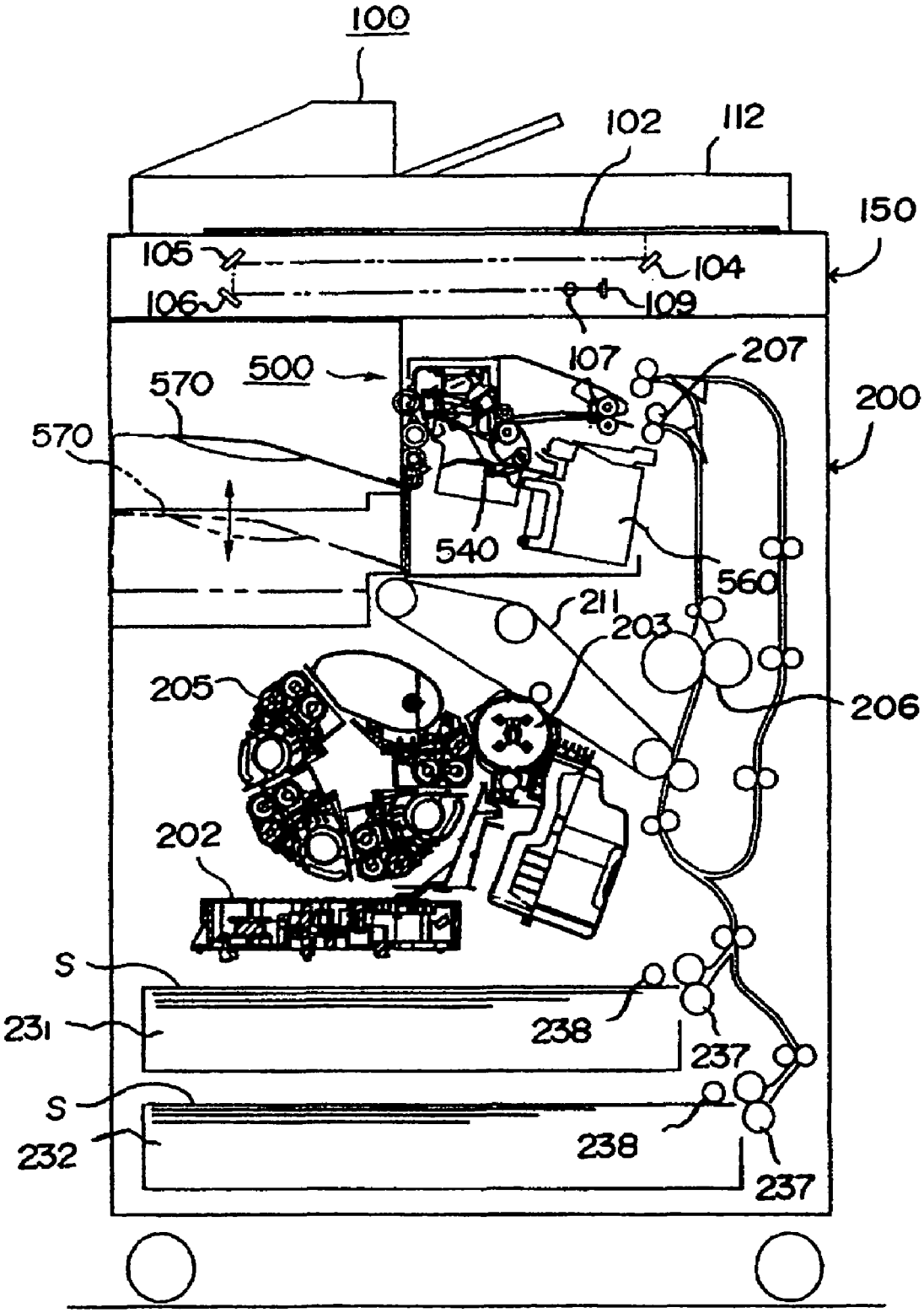
FIG. 1 is a cross sectional view of an image forming apparatus according to an embodiment.
Figure 2:
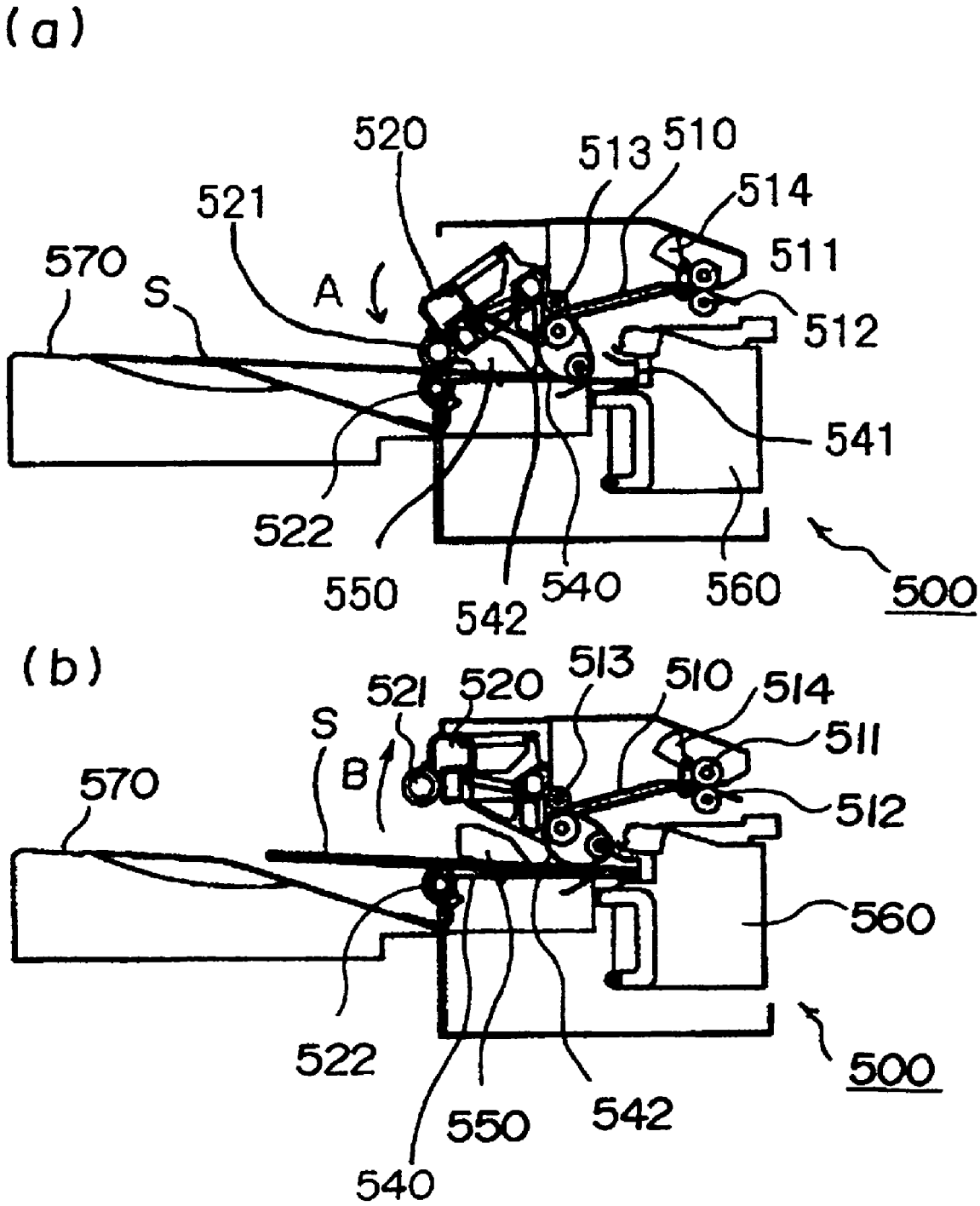
FIG. 2 is a cross sectional view of a sheet processing apparatus.
Figure 3:
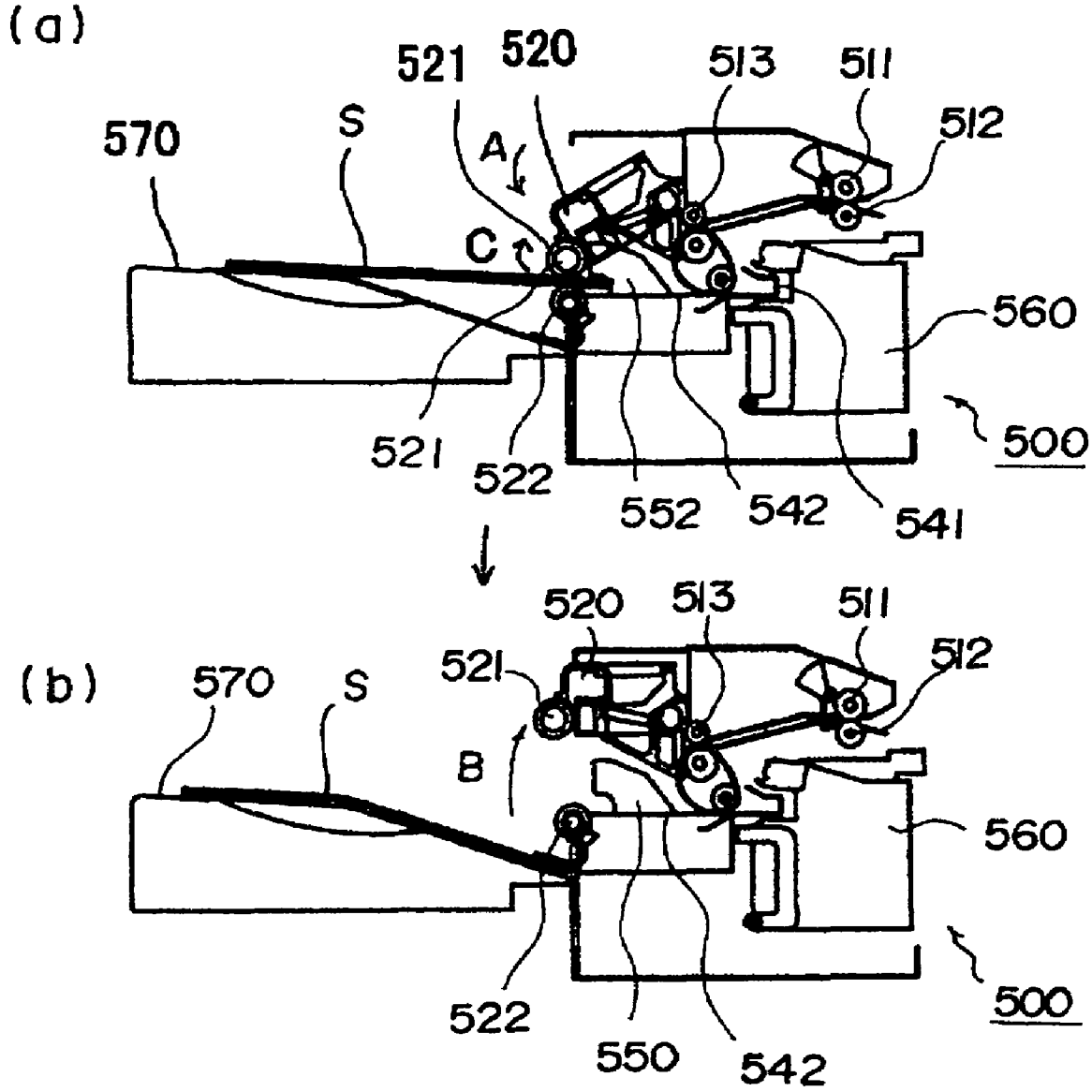
FIG. 3 is a cross sectional view of a sheet processing apparatus.

An embodiment of a sheet processing apparatus according to the present invention will be explained with reference to the drawings. FIG. 1 is a cross sectional view of an image forming apparatus main body 200 with a sheet processing apparatus 500 according to this embodiment mounted, and FIGS. 2, 3 are cross sectional views of the sheet processing apparatus 500.

(Entire Configuration)

As shown in FIG. 1, the image forming apparatus system comprises an original reading device 150, the image forming apparatus main body 200 and the sheet processing apparatus 500.

The sheet processing apparatus 500 provided above the image forming apparatus main body 200 and below the original feeding device 100, comprises a sheet stacking and aligning device. The sheets S with an image formed, and discharged from the image forming apparatus main body 200 are stacked temporarily on the processing tray 540 as the stack means, and after the process of stabling, aligning, or the like, they are aligned and stacked on the stack tray 570 provided substantially horizontally by the sheet stacking and aligning device.

The sheet stacking and aligning device can be one to be connected directly with the image forming apparatus main body 200 without the processing tray 540, or the sheet processing apparatus 500 can be one to be mounted outside the image forming apparatus main body 200.

The original reading device 150 has the automatic original feeding device 100 mounted above. The automatic original feeding device 100 separates above the originals set upwardly for feeding one by one successively from the top page in the leftward direction, feeds the same onto a platen glass 102 via a curved path, and discharges the same onto the discharging tray 112 after reading the originals.

By directing a light beam of an unshown lamp of the scanner unit 104 to the original, and guiding the light beam reflected from the original to an image sensor 109 via mirrors 105, 106, and a lens 107, the original can be read out. The original image read by the image sensor 109 has the image process applied so as to be sent to an exposure controlling part 202 of the image forming apparatus main body 200.

The exposure controlling part 202 directs a laser beam by the image information from the original reading device 150 onto a photosensitive drum 203 with the surface uniformly charged, to be an image forming means for forming an electrostatic latent image. The electrostatic latent image formed on the photosensitive drum 203 is developed by a developing device 205, and then it is transferred onto the intermediate transfer belt 211 as a toner image.

In contrast, the sheets S are picked up optionally and selectively from sheet cassettes 231, 232 by a pick up roller 238 comprising the sheet feeding means, and separated by a separating means 237 so as to be fed one by one. After correcting the obliqueness by the resist front roller pair, they are sent to a transfer position synchronously with the rotation of the intermediate transfer belt 211 so that the toner images formed on the intermediate transfer belt 211 are transferred onto the sheets S.

Thereafter, the sheets S are guided by the fixing roller pair 206 so that the toner images transferred on the sheets S are fixed permanently by applying the heating and pressuring process by the fixing roller pair 206. The sheets S with the toner images fixed are guided to the sheet processing apparatus 500 connected with the image forming apparatus main body 200 by the discharging roller pair 207.

(Sheet Processing Apparatus)

The sheet processing apparatus 500 comprises a processing tray 540 as a sheet stack means disposed on the sheet feeding direction upstream side, and a stack tray 570 disposed substantially horizontally on the downstream side vertically movably. The sheet processing apparatus 500 applies the sheet process such as the stapling process and the aligning process to the sheets S discharged from the discharging roller pair 207 of the image forming apparatus main body 200 by the processing tray 540 so as to stack the same on the stack tray 570.

The modes for the sheet process executed by the processing tray 540 include a sorting mode for sorting a plurality of sheets, a stapling mode for stapling a plurality of sheets by a stapler 560, or the like, and they are selected and set by an unshown setting means. Furthermore, the stapling position such as a one position stapling mode and a two position stapling mode can be selected so that the selected stapling process can be executed by moving the stapler 560 to the real stapling position depending on the setting content such as the sheet size and the binding position.

As shown in FIG. 2, the sheets S discharged from the image forming apparatus 200 are fed by the feeding roller 511 provided as the discharging means in the feeding path 510 of the sheet processing apparatus 500, the feeding roller 512 driven thereby, and the discharging roller pair 513. In the case the rear end of the sheets S passes by the rear end detecting sensor 514, the sheet rear end is discharged by a predetermined speed from the discharging roller pair 513.

As shown in FIG. 2A, at the timing with the sheet S rear end passes by the discharging roller pair 513, the sway arm 520 with one end supported rotatably is swayed in the arrow A direction so as to be supported rotatably by the other end of the sway arm 520, nipped by the sway roller 521 to be rotated and driven by an unshown driving source and the driven roller 522 driven thereby, and sent to the sheet rear end stopper 541.

As shown in FIG. 2B, the sheet S sent to the sheet rear end stopper 541 is released from the nip of the sway roller 521 and the driven roller 522 according to swaying of the sway arm 520 in the arrow B direction. The sheet S released from the nip is butted against the sheet rear end stopper 541 by a return belt 542 so as to align in the sheet feeding direction. Thereafter, the sheets S are aligned in the sheet width direction by an aligning plate 550 movable in the sheet width direction orthogonal to the sheet feeding direction. The aligning plate 550 may be disposed either on one side in the width direction of the sheet S or at two positions on the both sides in the width direction of the sheet S. At the time, in the case the processing tray 540 is a substantially horizontal tray, since the alignment in the sheet feeding direction may be disturbed at the time of the alignment by the aligning plate 550, the alignment is executed again by the return belt 542 in the feeding direction.

After finishing the alignment of a predetermined number of the sheets, in the case the stapling mode is selected by the operating part, the stapler 560 as the sheet processing means staples at the binding position designated by the operating part. Thereafter, as shown in FIG. 3A, the sway arm 520 is swayed in the arrow A direction so as to rotate the sheet bundle S with the binding process in a state clamped by the sway roller 521 and the driven roller 522 in the arrow C direction for discharging the sheet bundle with the binding process onto the stack tray 570. After discharging the sheet bundle, as shown in FIG. 3B, the sway arm 520 is swayed in the arrow B direction for preparing for the subsequent sheet process and alignment.

Figure 4:
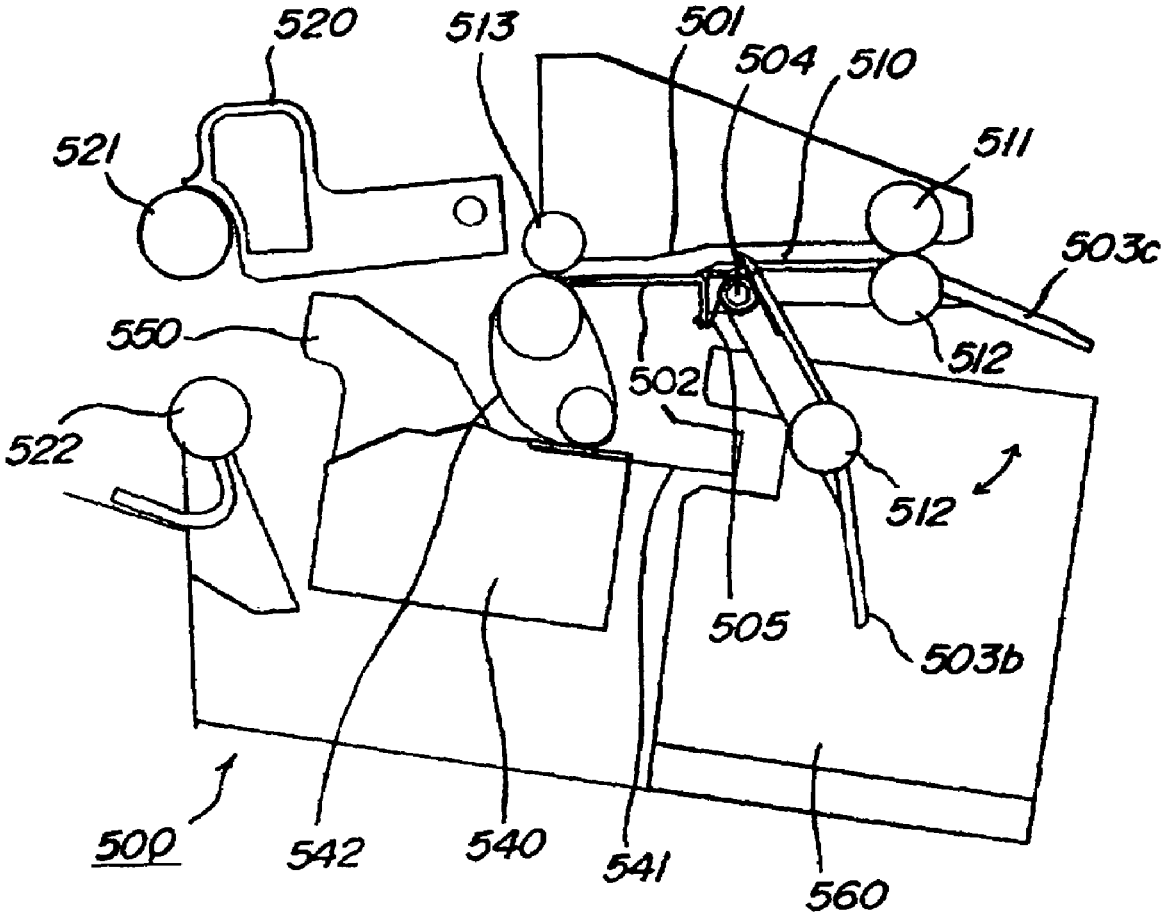
FIG. 4 is an essential part cross sectional view of a sheet processing apparatus.
Figure 5:
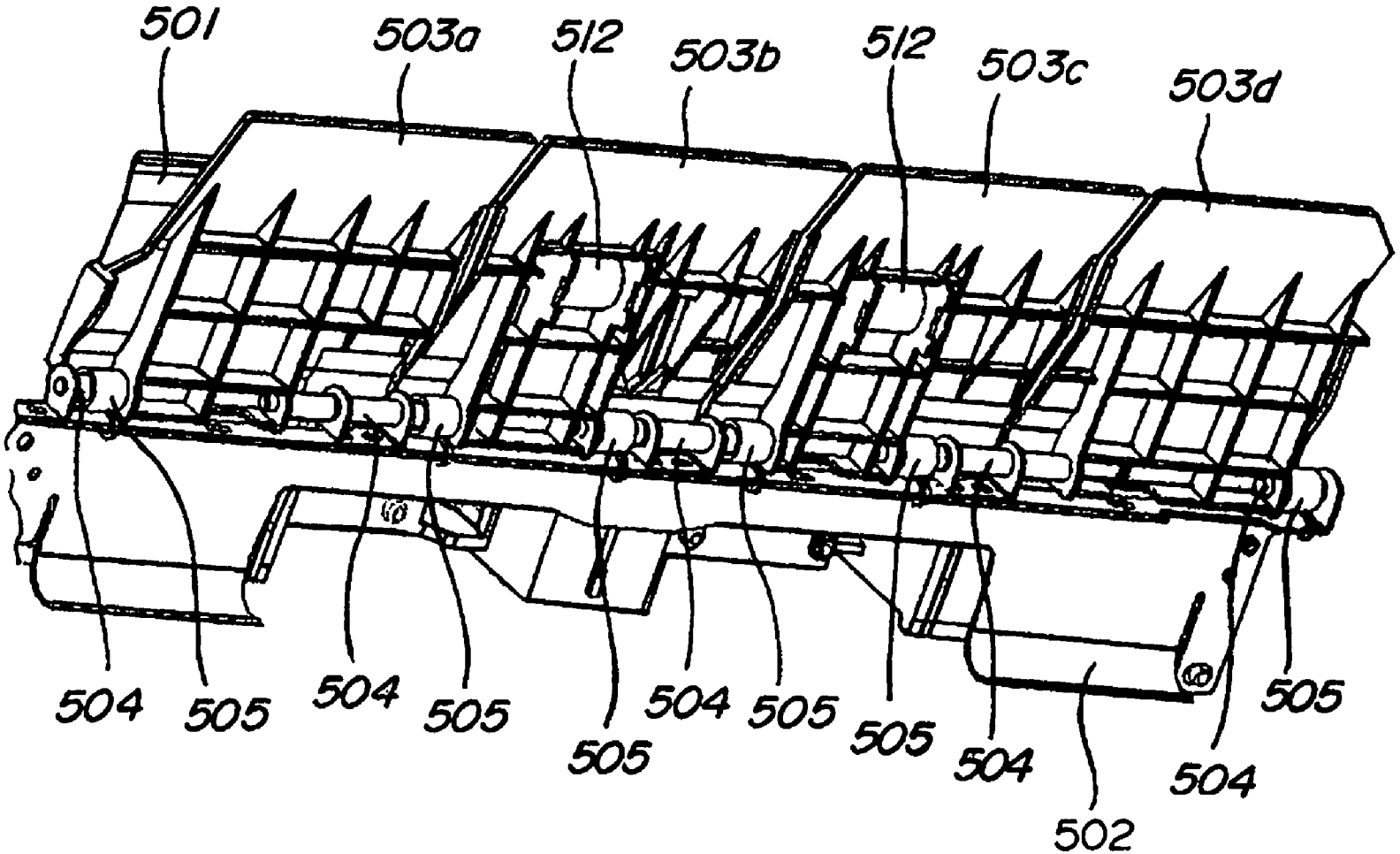
FIG. 5 is a perspective view of a feeding path of a sheet processing apparatus.

Next, the configuration of the feeding path 510 of the sheet processing apparatus will be explained with reference to FIGS. 4, 5. The feeding path 510 comprising an upper feeding guide 501 as a guiding member, a lower feeding guide 502, and a divided feeding guide 503, is provided above the stapler 560.

The divided feeding guide 503 (503*a*, 503*b*, 503*c*, 503*d*) is divided in four parts in the sheet width direction. The feeding roller 511 is supported rotatably on the upper feeding guide 501, and the driven roller 512 is supported by the divided feeding guides 503*b* and 503*c* according to the contact with the feeding roller 511.

The parts 503*a*, 503*b*, 503*c*, 503*d* of the divided feeding guide 503 are interlocked with the lower feeding guide 502 each via a hinge 504 so as to be opened or closed downwardly with the hinge 504 as the fulcrum. A spring 505 is wound around each on the hinge 504, and the divided feeding guide 503 is forced to the upper feeding guide 501 side by the spring 505.

Figure 6:
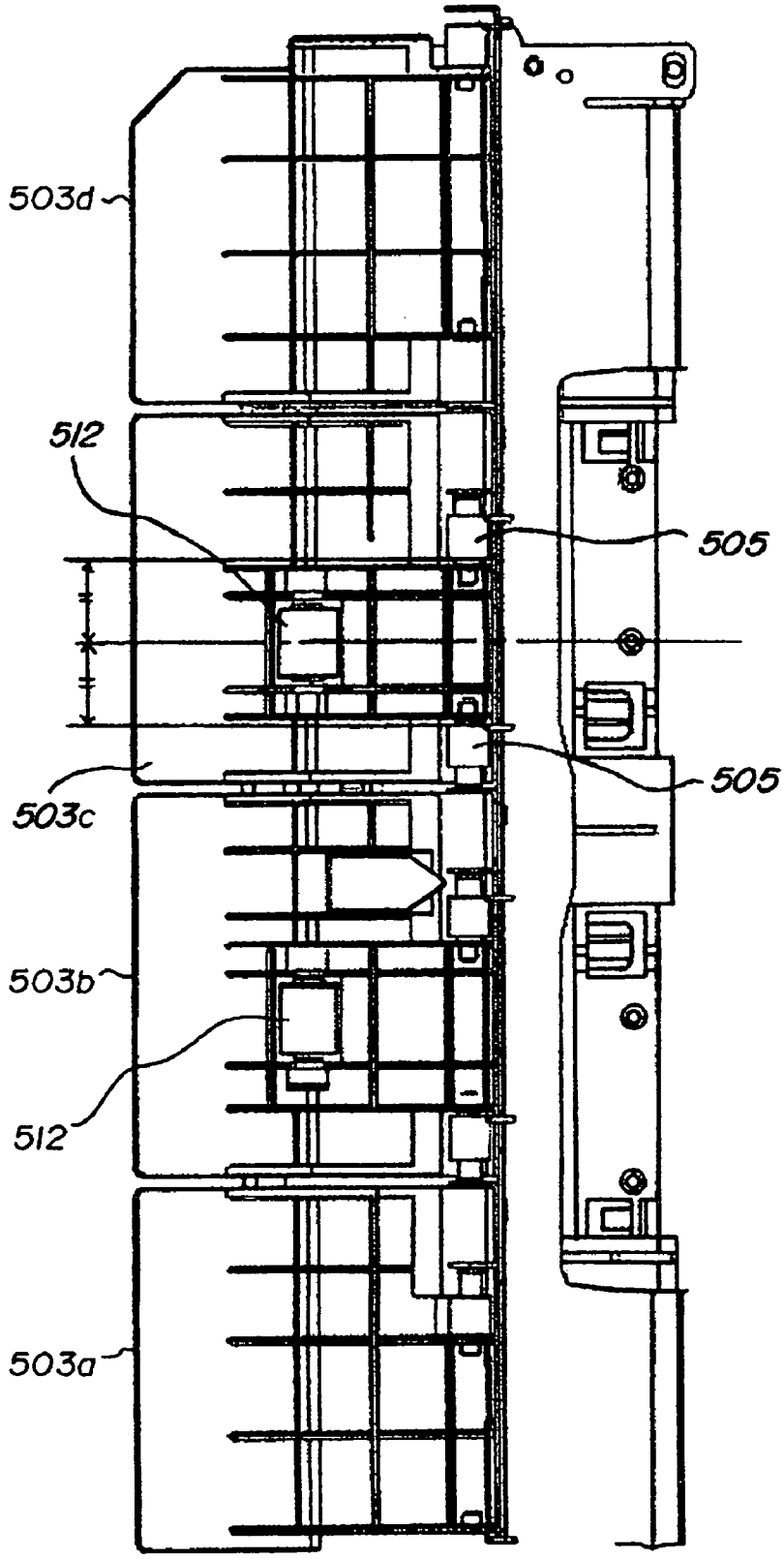
FIG. 6 is a diagram showing the positional relationship between a feeding roller and a spring provided in a divided feeding guide of a sheet processing apparatus.

Moreover, as shown in FIG. 6, since the springs 505 are disposed in the central two parts 503*b*, 503*c* of the divided feeding guide 503 from the width direction center of the driven roller 512 at equal interval positions, compared with the case of providing the feeding guide integrally, the pressuring force between the driven roller and the feeding roller cannot be influenced by the tilt of the feeding guide by the mounting error, or the like so that the driven roller 512 can be forced by an even pressuring force with respect to the feeding roller 511.

Figure 7:
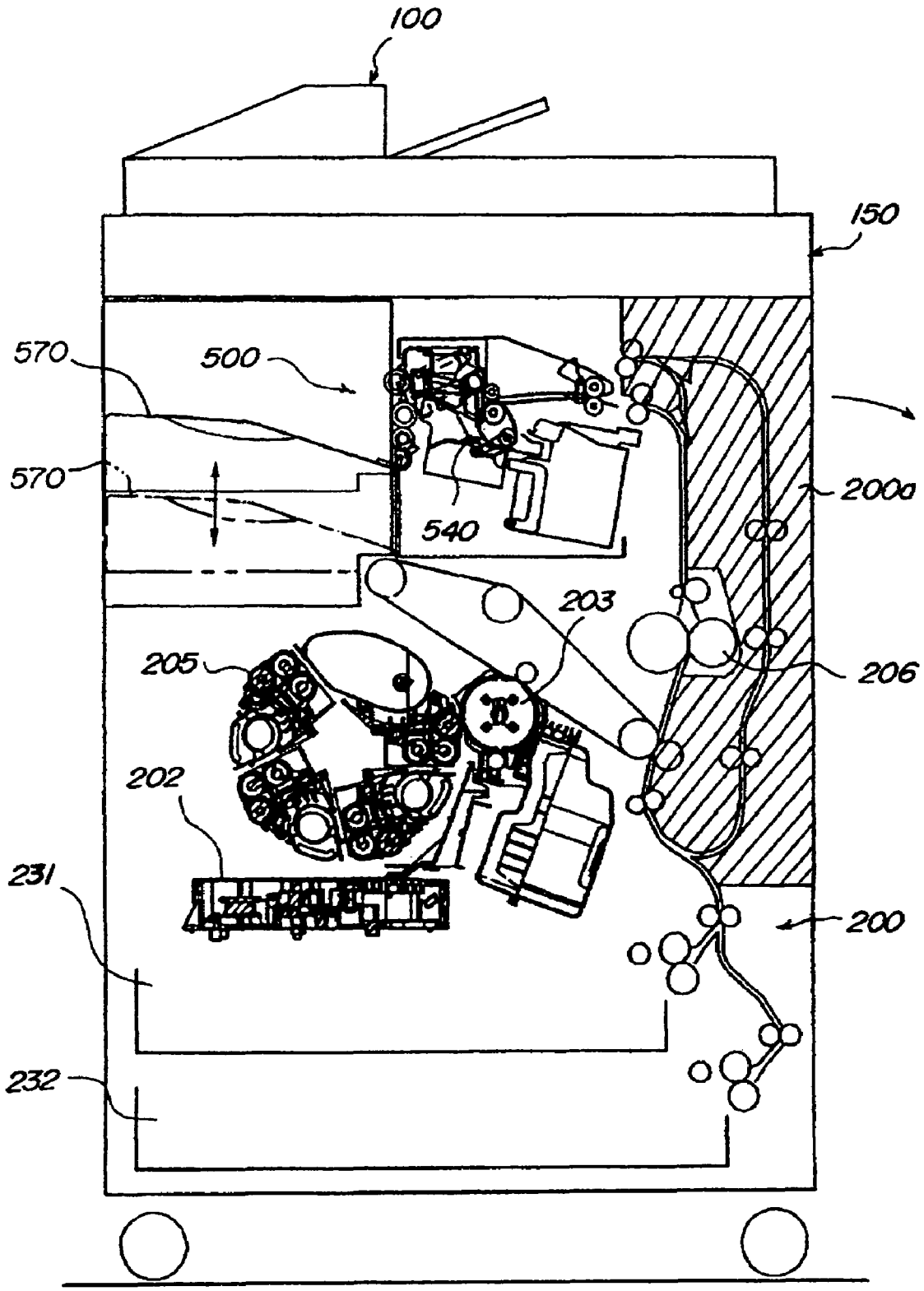
FIG. 7 is a diagram for explaining an operation for eliminating a sheet choked in the feeding path of a sheet processing apparatus.

Next, the operation of eliminating the sheet S in the case the sheet S is choked in the feeding path 510 will be explained. As shown in FIG. 7, the right door 200*a* (the parts marked by the slant lines in FIG. 7) of the image forming apparatus main body 200 is opened for eliminating the sheet S. Since the configuration of FIG. 7 differs from the configuration of the image forming apparatus of FIG. 1 only by the right door 200*a*, explanation is omitted for the other same parts.

Figure 8:
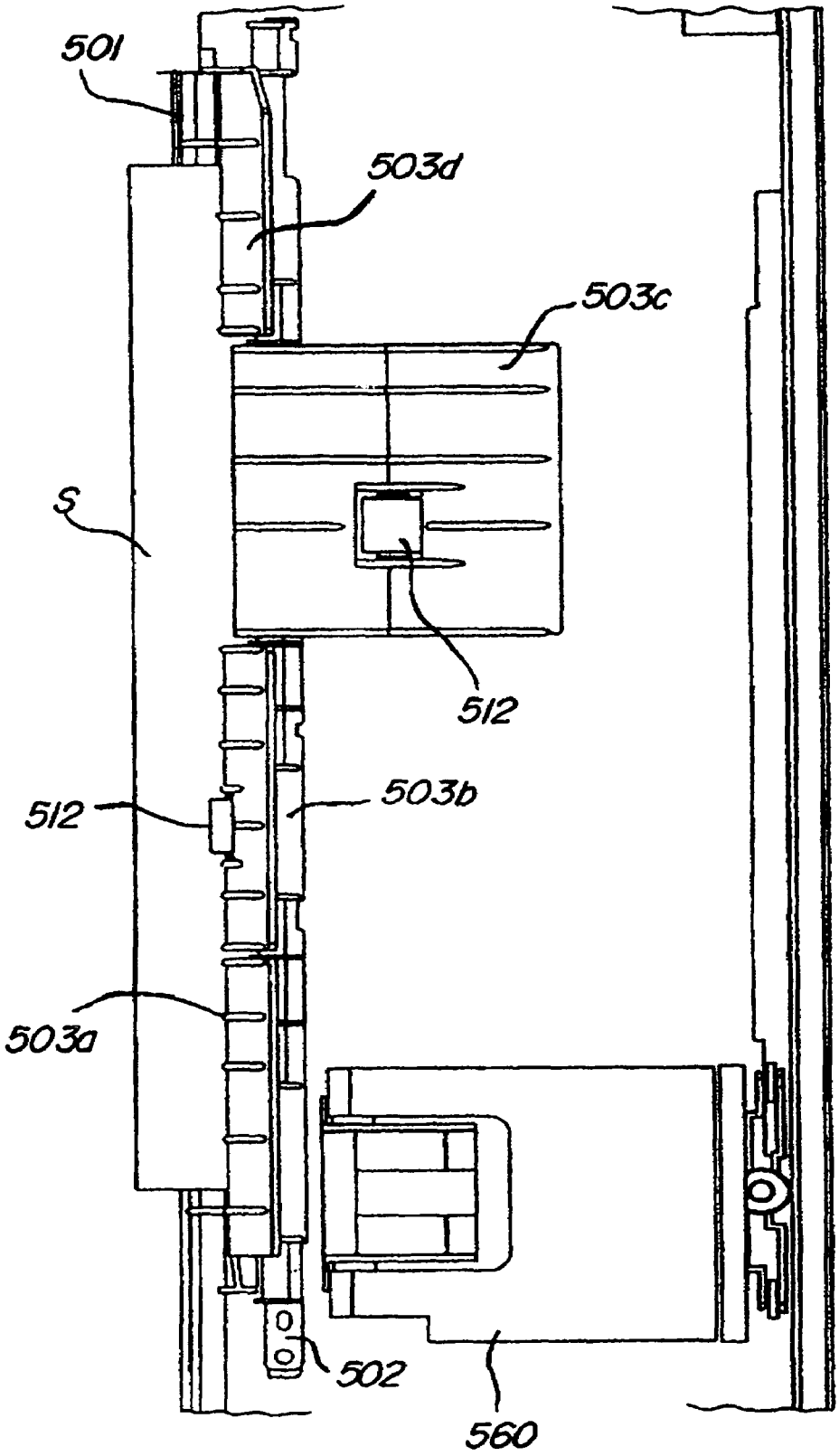
FIG. 8 is a diagram showing the positional relationship between a divided guide and a stapler at the time of eliminating a sheet choked in the feeding path of a sheet processing apparatus.
Figure 9:
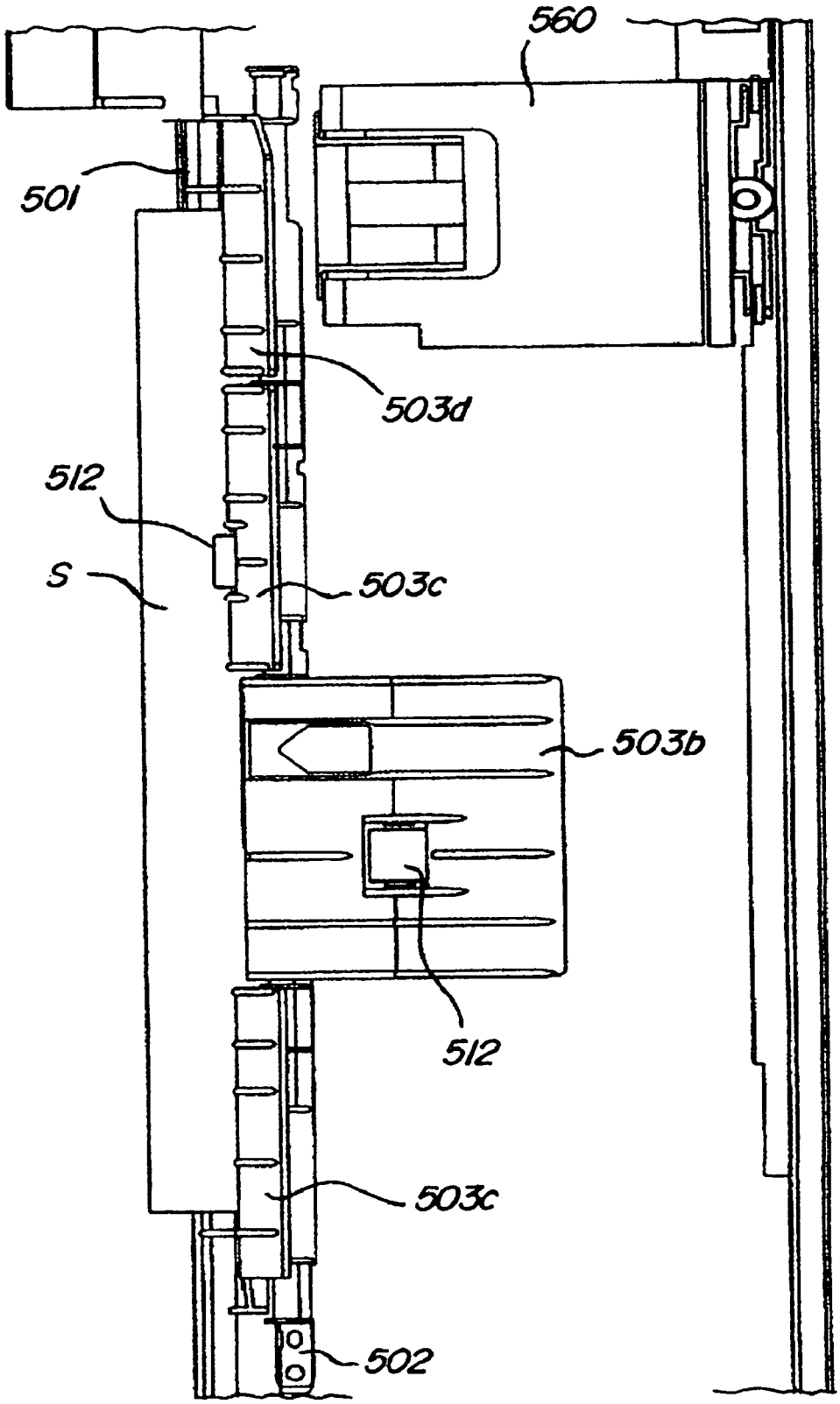
FIG. 9 is a diagram showing the positional relationship between a divided guide and a stapler at the time of eliminating a sheet choked in the feeding path of a sheet processing apparatus.
Figure 10:
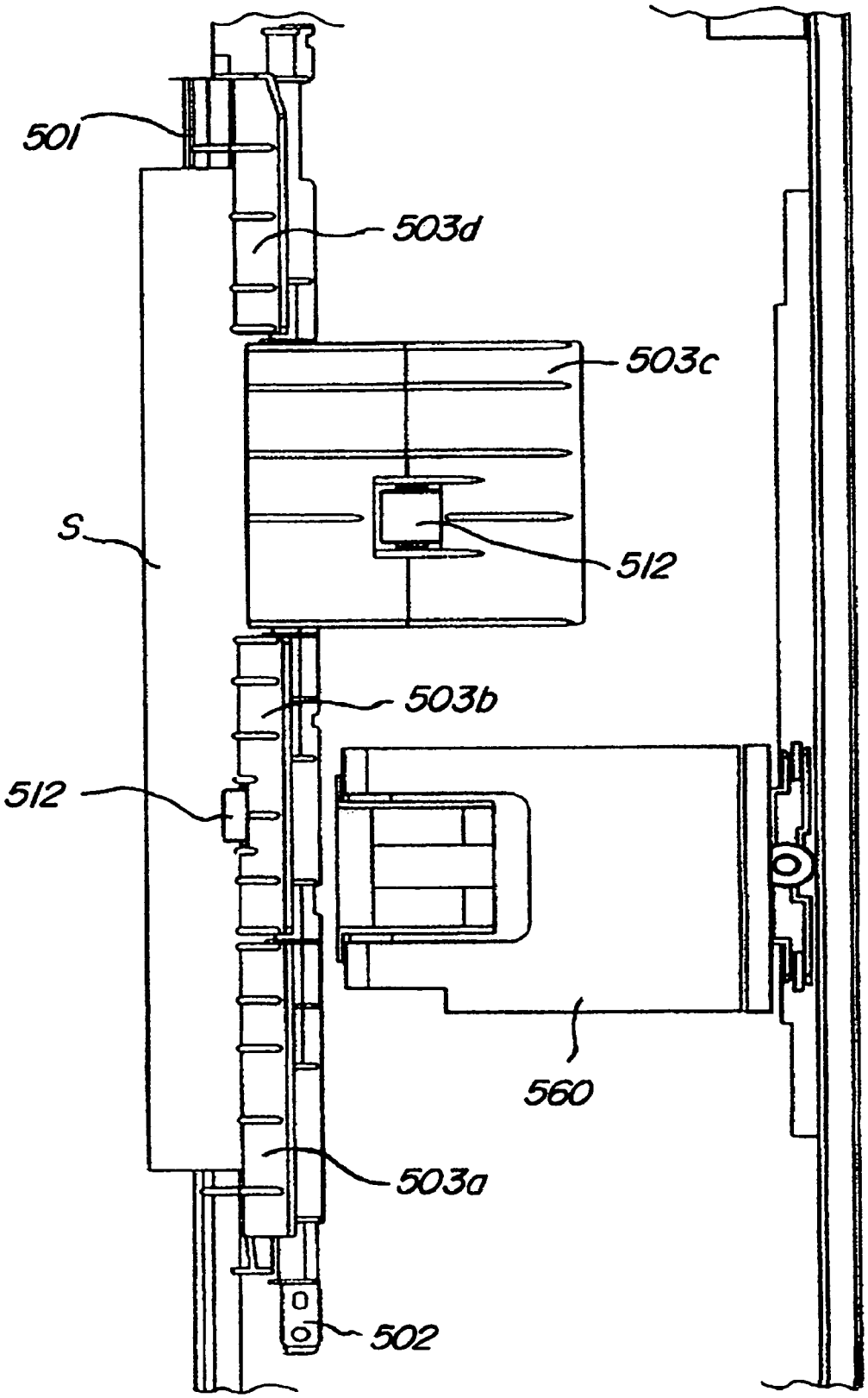
FIG. 10 is a diagram showing the positional relationship between a divided guide and a stapler at the time of eliminating a sheet choked in the feeding path of a sheet processing apparatus.
Figure 11:
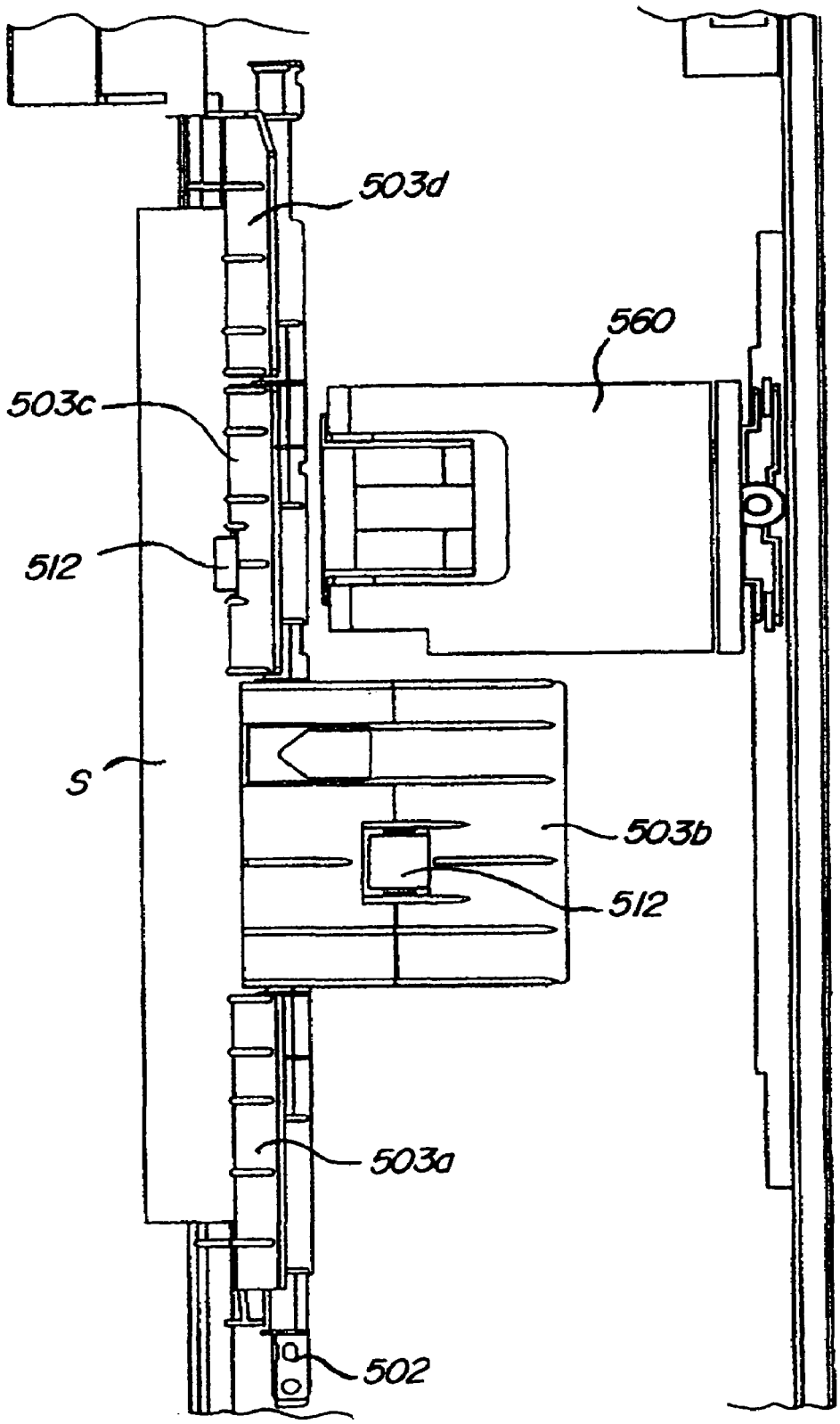
FIG. 11 is a diagram showing the positional relationship between a divided guide and a stapler at the time of eliminating a sheet choked in the feeding path of a sheet processing apparatus.
Figure 12:
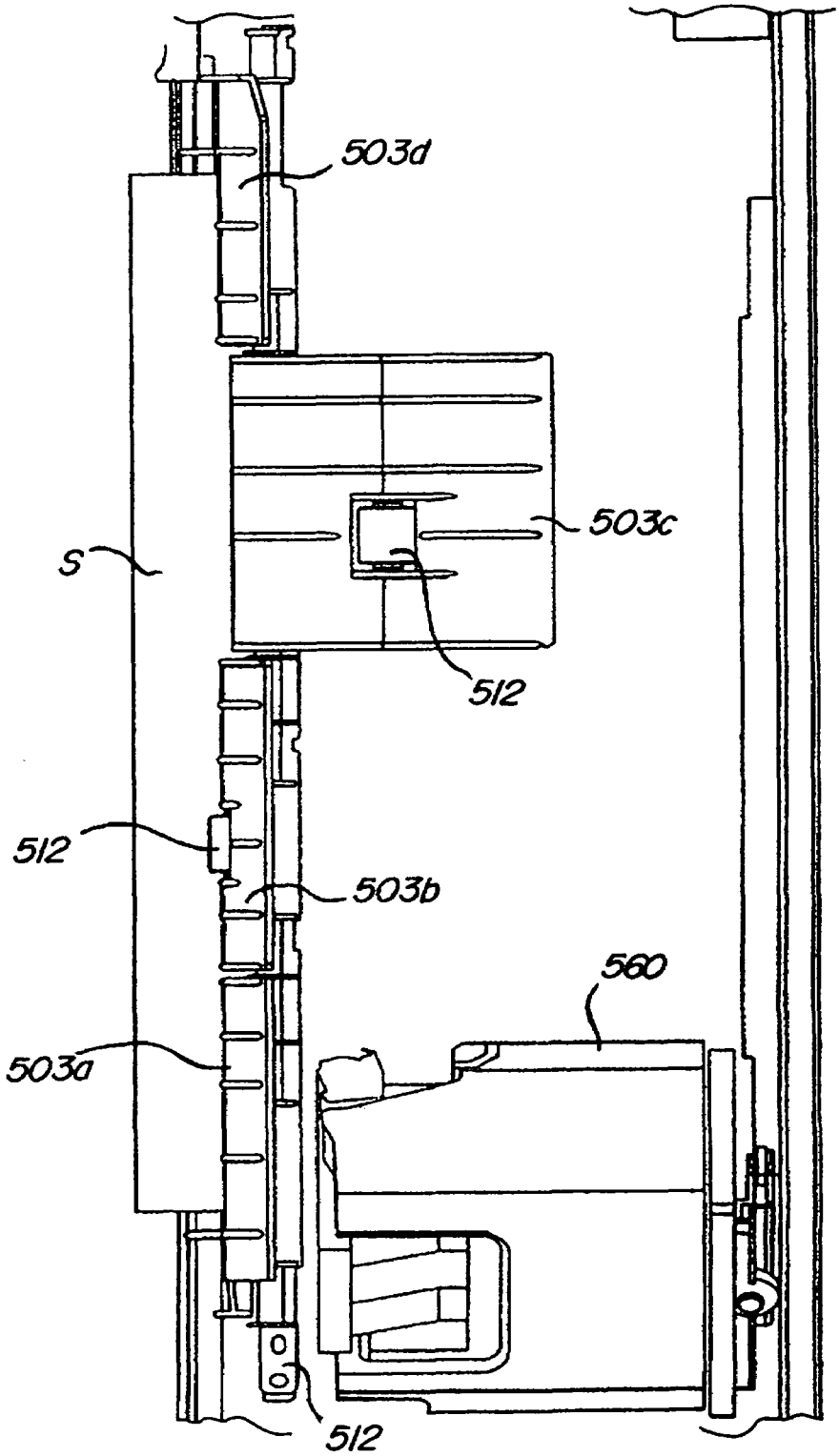
FIG. 12 is a diagram showing the positional relationship between a divided guide and a stapler at the time of eliminating a sheet choked in the feeding path of a sheet processing apparatus.
Figure 13:
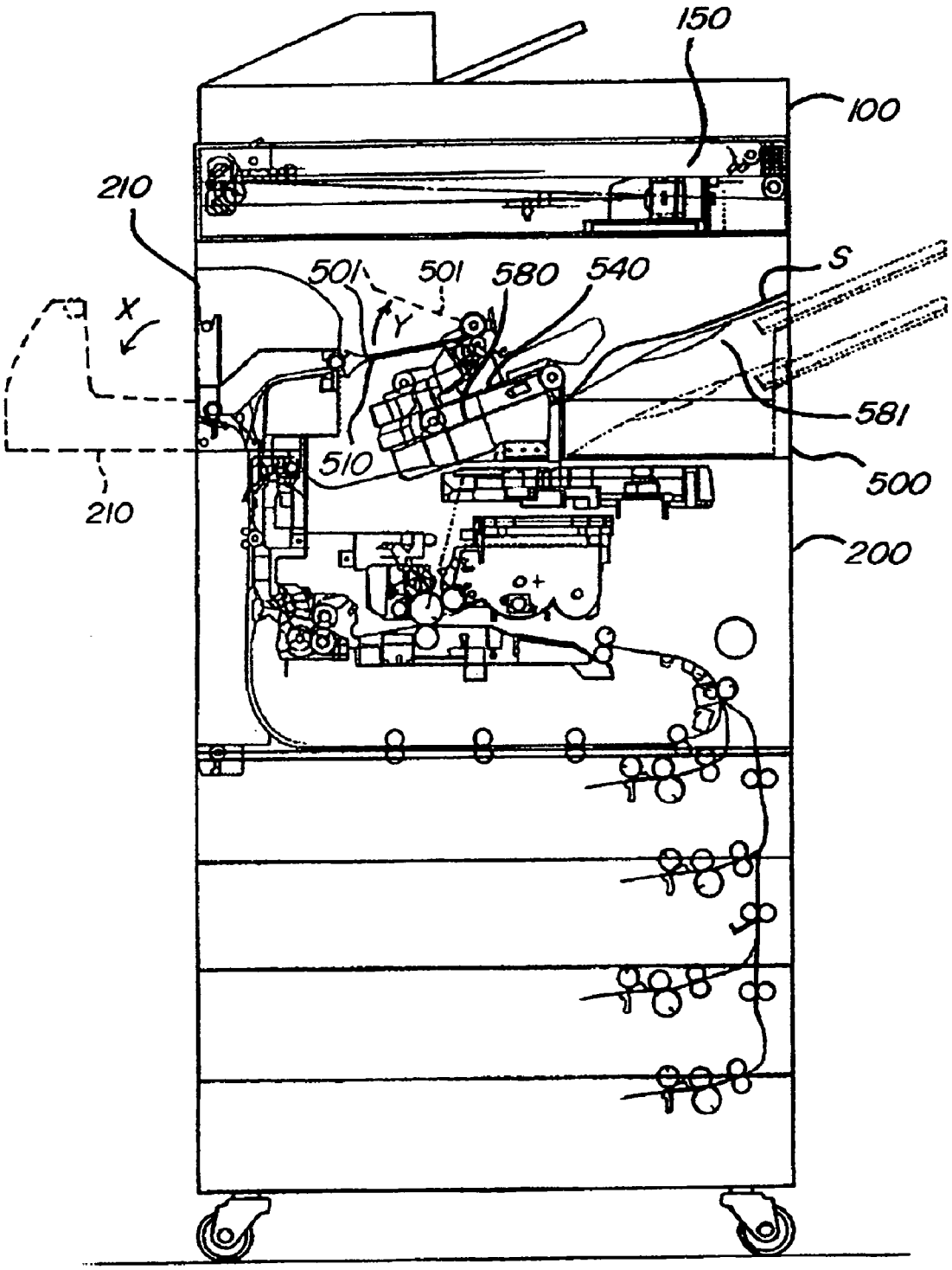
FIG. 13 is a cross sectional view showing the entire configuration of the conventional sheet processing apparatus.

FIGS. 8 to 12 show the positional relationship of the stapler 560 and the divided feeding guide 503 in a state with the right door 200*a* (FIG. 7) opened. FIG. 8 shows the state of binding the sheets stacked on the processing tray at one point on the front side, FIG. 9 the state of binding the sheets stacked on the processing tray at one point on the deeper side, FIG. 10 the state of binding the sheets stacked on the processing tray at two points on the front side, FIG. 11 the state of binding the sheets stacked on the processing tray at one point on the deeper side, and FIG. 12 the state of executing a processing mode other than the above-mentioned.

As shown in FIGS. 8 to 12, at least one of the divided feeding guide 503 can be opened or closed downwardly. Accordingly, by opening the divided feeding guide 503 downwardly, the sheet S choked in the feeding path 510 can be confirmed visually, and by opening the divided feeding guide 503 downwardly further widely, the workability for eliminating the sheet S choked in the feeding path 510 can be improved.

As mentioned above, by dividing the divided feeding guide 503, the feeding roller 511, and the feeding roller 512 can be pressured evenly so that the obliqueness of the sheets derived from the uneven pressure of the feeding roller 511 and the feeding roller 512 can be prevented. Moreover, since the divided feeding guide 503 can be opened and closed so that the eliminating processing space for eliminating the sheet choked in the feeding path of the sheet processing apparatus can be ensured, the workability can be improved.

Moreover, since the divided feeding guide 503 can be opened and closed in the moving space of the stapler 560 of the sheet processing apparatus 500, the stapler 560 moving space can be utilized as the rotating space of the divided feeding guide 503 so that the rotating space of the divided feeding guide 503 for the jamming process needs not be provided additionally, and as a result, the space can be saved for the entire sheet processing apparatus 500.

Moreover, also as to the workability, since at least one of the divided feeding guides 503 can be opened without interference with the stapler 560 regardless of the position of the stapler 560, the visual confirming property of the sheet choked in the feeding path 510 of the sheet processing apparatus 500 can be improved.

Moreover, since at least one of the divided feeding guides 503 without interference with the stapler 560 can be downwardly opened widely regardless of the position of the stapler 560, the stapler 560 needs not be moved to a position without disturbing the process before the eliminating process for the sheet choked in the feeding path 510 of the sheet processing apparatus 500 so that the eliminating processing time for the choked sheet can be shortened.

Although an example of dividing the guide member 503 into the four parts has been explained in this embodiment, the number of dividing the guide member 503 is not limited thereto, and two or more numbers can be selected optionally.

Although the structure of opening the feeding path 510 by providing the parts 503*a*, 503*b*, 503*c*, 503*d* rotatably around one end has been explained in this embodiment, the feeding path 510 can be opened not only by this structure, and a movable structure of the guide member 503 for taking out the jammed sheet S per each part 503*a*, 503*b*, 503*c*, 503*d*, or a detachable structure can be used as well.

Moreover, although the divided structure with the lower feeding guide member to be opened has been explained in this embodiment, a divided structure with the upper feeding guide member to be opened can be used as well.

Furthermore, although an example of the stapler for executing a binding process of a sheet bundle has been explained as the sheet processing means, it is not limited thereto, and it is needless to say that the same effect an be obtained by a punching means for applying a punching process to the sheets as the sheet processing means, a book binding means such as a gluing means for gluing on the sheet bundle end part, or a tape adhering means for adhering a binding tape on the sheet bundle end part.

I claim:

1. A sheet processing apparatus comprising:

a pair of conveyance rotary members which conveys sheets;

a stack tray which stacks the conveyed sheets;

a pair of guide members which guides the sheets to the stack tray; and a sheet processing means which moves along the edge of the sheets stacked on the stack tray and which processes the sheets, wherein one of the pair of guide members is divided to a plurality of parts in the direction in which the sheet processing means moves and each part is capable of opening within the space in which the sheet processing means moves.

2. The sheet processing apparatus according to claim 1, wherein at least one of the plurality of the parts is capable of opening without interference with the sheet processing means, irrespective of any position of the sheet processing means.

3. The sheet processing apparatus according to claim 1, wherein one of the pair of conveyance rotary members is supported by the divided guide member.

4. The sheet processing apparatus according to claim 3, wherein at least two parts of the divided guide members support respectively one of the pair of conveyance rotary members while the other conveyance rotary member is pressed evenly.

5. The sheet processing apparatus according to claim 1, wherein the pair of the guide members are provided above the sheet processing means.

6. An image forming apparatus comprising:

an image forming means which forms an image on a sheet; and a sheet processing apparatus which processes the sheet on which an image is formed by the image forming means, wherein the sheet processing apparatus comprises:

a pair of conveyance rotary members which conveys sheets;

a stack tray which stacks the conveyed sheets;

a pair of guide members which guides the sheets to the stack tray; and a sheet processing means which moves along the edge of the sheets stacked on the stack tray and processes the sheets, wherein one of the guide members is divided to a plurality of parts in the direction in which the sheet processing means moves and each part is capable of opening within the space in which the sheet processing means moves.

7. The image forming apparatus according to claim 6, wherein at least one of the plurality of the parts is capable of opening without interference with the sheet processing means, irrespective of any position of the sheet processing means.

8. The image forming apparatus according to claim 7, further comprising a door provided for accessing space formed when the pair of the guide members are opened, from outside the apparatus.

9. The image forming apparatus according to claim 6, further comprising a door provided for accessing space formed when the pair of the guide members are opened, from outside the apparatus.

* * * * *

UNITED STATES PATENT AND TRADEMARK OFFICE

CERTIFICATE OF CORRECTION

PATENT NO. : 7,195,240 B2
APPLICATION NO. : 11/452205
DATED : March 27, 2007
INVENTOR(S) : Junichi Moteki It is certified that error appears in the above-identified patent and that said Letters Patent is hereby corrected as shown below:

ON THE TITLE PAGE:
At Item (*), Notice, insert Terminal Disclaimer.

COLUMN 1:
Line 35, “self” should read --own--.
Line 59, “an” should read --a--.

COLUMN 2:
Line 9, “to” (first occurrence) should read --of--.
Line 34, “per” should read --by--.
Line 43, “stabling” should read --stabilizing--.

COLUMN 7:
Line 15, “to” should read --into--.
Line 34, “are” should read --is--.

COLUMN 8:
Line 3, “sheet; and” should read --sheet; ¶ and--.
Line 15, “to” should read --into--.
Line 27, “are” should read --is--.
Line 31, “are” should read --is--.

Signed and Sealed this

Fourth Day of December, 2007

JON W. DUDAS
*Director of the United States Patent and Trademark Office*